US005420830A

United States Patent [19]

Camaratta, Jr. et al.

[11] Patent Number: 5,420,830

[45] Date of Patent: May 30, 1995

[54] CHESS CLOCK

[75] Inventors: Frank A. Camaratta, Jr., Huntsville, Ala.; William Goichberg, Salisbury Mills, N.Y.

[73] Assignee: United States of America Chess Federation, New Windsor, N.Y.

[21] Appl. No.: 209,639

[22] Filed: Mar. 10, 1994

[51] Int. Cl.[6] ..... G04F 3/00

[52] U.S. Cl. ..... 368/96

[58] Field of Search ..... 368/96

[56] References Cited

U.S. PATENT DOCUMENTS 4,062,180 12/1977 Meshi et al. ..... 368/96

4,884,255 11/1989 Fischer ..... 368/96

OTHER PUBLICATIONS

"Inside Chess", Sep. 7, 1993, p. 26, Advertisement for Chronos chess clock.

*Primary Examiner*—Bernard Roskoski

*Attorney, Agent, or Firm*—Lucas & Just

[57] ABSTRACT

A clock, especially suitable for playing the game of chess, includes the standard two clock face system with an activation button for each player. A delay feature is included so that there is a delay between the time the activation button is pressed and the time that the activated clock actually commences movement. The benefit of the clock is to reduce the likelihood that a player with positional and/or material superiority will lose a match solely because of the expiration of time on that player's time clock.

8 Claims, 2 Drawing Sheets

CHESS CLOCK

The present invention relates to clocks, and in particular to a clock to be used in the timing of a competitive event where each side's total elapsed time is controlled, notably in the game of chess.

Chess is a game in which a player can analyze a certain position during the course of play for many hours, or even days, before deciding on the next move. While such delays are routine in matches played by mail, it is generally considered advisable to set a time limit for matches played in person. There are a number of ways in which this can be done, such as allowing each player a particular number of minutes to make that player's next move, and, if the player fails to move by that time, the match is forfeited. One of the drawbacks to this type of match is that moves can be made comparatively rapidly at the beginning but, in the mid-game, there are many units positioned throughout the board, which considerably complicates the analysis.

One of the solutions that has been adopted is to allow each player a predetermined time for making all of that player's moves during the course of the game. A typical game might allow an hour for each player. When the first player moves, his time to make that move from the declared start of the game is counted. When the opposing player moves, his time between the first move and his move is counted, and so on.

The means for measuring the elapsed time of each player is typically done with a clock which has two adjoining clock faces, one being for player A and the other being for player B. After player A makes his move, he presses a button on top of the clock which starts player B's time elapsing. Player B can take as long as he wants to move; when he has moved, he presses a separate button on top of the clock. This separate button simultaneously stops player B's clock and starts player A's clock. The game then continues in this manner until a conclusion has been reached, i.e. one of the players is checkmated, one of the players resigns, the players declare a draw, a draw is declared pursuant to the rules of chess, or one of the players runs out of time. The present invention is directed towards minimizing an anomaly which can occur in a chess match in which a player with a substantial material and positional superiority over his opponent nevertheless loses because the player has run out of time.

An example of the foregoing situation is where player A is left with one or two pawns along with a king and queen and player B has only a king and a bishop. Player A has a vast material superiority. However, to get to this situation, player A has used all but the last 15 seconds of the one hour of allotted time. Player B, who has quite a bit of time remaining on his clock, can make evasive moves that might prevent player A from achieving checkmate before the expiration of the time limit, even though player A has a vast material superiority. This results in a rather inequitable conclusion to the match. While the foregoing is an extreme example, there are many matches where a player loses solely because the player runs out of time, even though that player has superior position and material.

Chess players have long recognized the disadvantages of working with the clock and with a predetermined time for each player. However, in order to run tournaments in a timely manner and to preclude a player from taking inordinate amounts of time to decide on a move, clocks have become widely accepted in chess matches throughout the United States and throughout the world.

One of the persons who recognized the problem with the existing clock system is Bobby Fischer, a world champion chess player. Fischer's U.S. Pat. No. 4,884,255 describes a system to try to overcome the problem with timed chess as previously described. In the Fischer patent, a predetermined time, e.g. two minutes, is allotted for each move. Each player is also allotted a specific period of time, e.g. 60 minutes, for additional use in making moves. Every time a move is made in under two minutes, additional time is added to the base 60 minutes. Conversely, every time a move takes more than two minutes, the time in excess of the two minutes is deducted from the base 60 minutes. Consequently, the player who is extremely short of time can have time added to the clock by making one or more moves quickly. Thus, the game is unlikely to end because one player runs out of time. The addition of an increment for each relatively fast move (e.g. 4–5 seconds) adds almost two minutes to the player's base time. If one player can move very rapidly, that player can build up a large reservoir of time to be used at the end game. It is to be noted that the two minutes are awarded for each and every move and, thus, a number of rapid moves can add considerable time to one or both player's clocks, and the total amount of time that a match can take can be substantially extended. This can be a serious disadvantage. It is important that the start and end times for each round are known by the players beforehand in the tournament.

In accordance with the present invention, the play of chess is controlled by a clock, but the disadvantage of a player with positional and material superiority running out of time is virtually eliminated and, yet, the total time for completing the match is not excessively lengthened.

The present invention accomplishes this result by inserting a time delay circuit in each of the clocks. When player A finishes his move and presses the button to start player B's clock, player A's clock immediately stops, but player B's clock does not start until after a predetermined period of time. In this way, even if player B is close to running out of time, player B still has the delay time to effect a move. At the same time, in the early portion of the game, where moves are frequently made quite rapidly, the delayed start of the clock permits a move which takes virtually no time off of the allotted time but, at the same time, does not "reward" the player with additional time for making rapid moves.

The predetermined delay can be any amount of time which the players or the tournament director decide that it should be. While this could encompass a number of minutes, it is preferred that the delay be measured in seconds, suitably from about 1 to about 9 seconds and more preferably from about 3 to about 6 seconds. It is noted that the delay will generally be longer if the base time is longer. For example, if the preselected base time is 60 minutes, the delay is suitably 4 to 6 seconds, while if the preselected base time is five minutes (a "lightning" game), the delay would suitably be only 1 or 2 seconds.

These and other aspects of the present invention may be more fully understood with reference to the drawings in which.

Figure 1:
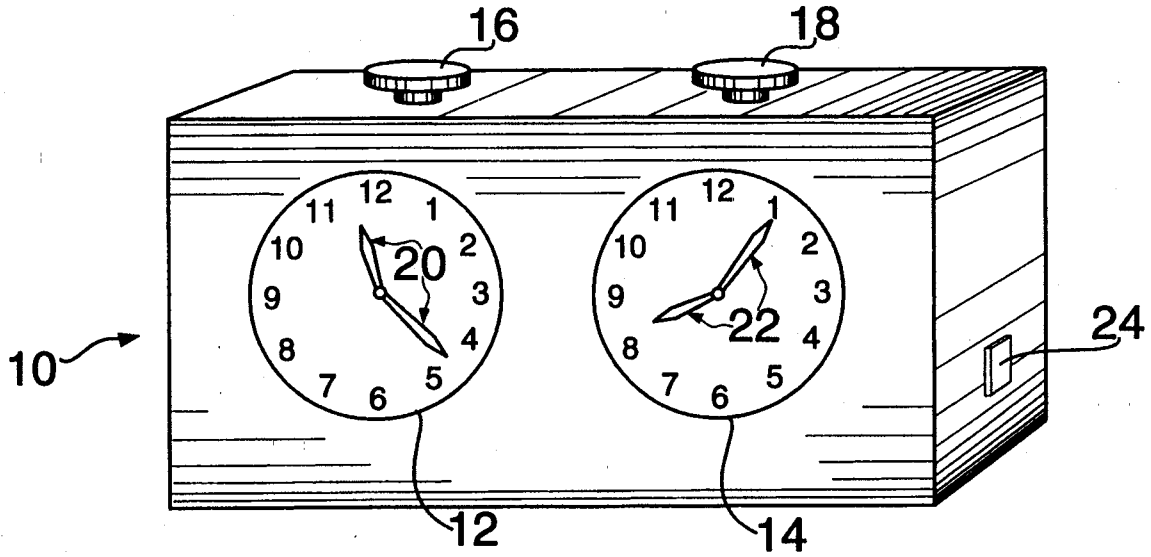
FIG. 1 shows a clock according to the present invention.

Referring to FIG. 1, there is shown a chess clock 10 having two clock faces 12 and 14 and two activation buttons 16 and 18. Each activation button 16, 18 has an operative and an inoperative position. Player A's activation button is 16 and his clock face is 12. Player B's activation button is 18 and his clock face is 14. When player A presses button 16 and moves it into its operative position, it automatically moves button 18 to its inoperative position and simultaneously stops the hands 20 of the clock face 12 from moving. In a standard chess clock, player A's pressing of button 16 also simultaneously starts in motion the hands 22 on the clock face 14. After player B has made his move, he presses button 18 which simultaneously moves button 16 to its inoperative position, stops his clock hands 22, and starts the movement of the clock hands 20 of player A's clock.

In accordance with the present invention, there is provided a delay button 24. The delay button suitably has indicia such as numerals thereon for indicating the amount of delay which will be allowed each player in a particular match. Assume the instance where the delay button 24 is set to a delay time of 6 seconds. When player A presses button 16, the hands 20 on clock face 12 will immediately stop. However, the hands 22 on clock face 14, which is player B's clock face, will not start moving until 6 seconds have elapsed. Similarly, when player B presses button 18, the hands 22 on clock face 14 will immediately stop. However, the hands 20 on clock face 12, which is player A's clock face, will not start movement until after the delay time of 6 seconds.

In the embodiment illustrated, there is but a single delay button 24, and delay button 24 causes a delay in the start of timing of both clocks. This can be done either electronically, as described hereinafter with respect to FIG. 2, or mechanically, as for example with a bevel gear. It will be appreciated, however, that there could be separate delay buttons 24 for each of the clocks, e.g. with the delay for clock face 14 being in the position of button 24 and the delay button for the clock face 12 being similarly situated on the left end (not shown) of clock 12. While it is preferred that both clocks have the same amount of delay, it is within the contemplation of the present invention that the clocks could have different delay times, e.g. where a better player is playing a lesser player, or that one of the clocks could have the delay feature and the other run in standard manner, i.e. the other commencing running as soon as the activation button is depressed.

It is not necessary that the delay feature of the present invention be used throughout the play of the game. In order to reduce the total amount of time allowed for a game, the delay feature can be initiated only towards the end of the game, e.g. when one of the players has only 5 to 10 seconds remaining. In this way, the game will be played in regular fashion for most of the alloted time but, in the end game, the delay feature is initiated in order to avoid a checkmate caused solely by the expiration of time. When one of the players reaches the last 5 to 10 seconds, the delay feature can be initiated either automatically or manually. At that point, the delay feature can be introduced for both players, or for only that player whose time is close to expiring. If the situation is the latter, then the delay feature would also be introduced for the other player when that player's time came close to expiring.

Figure 2:
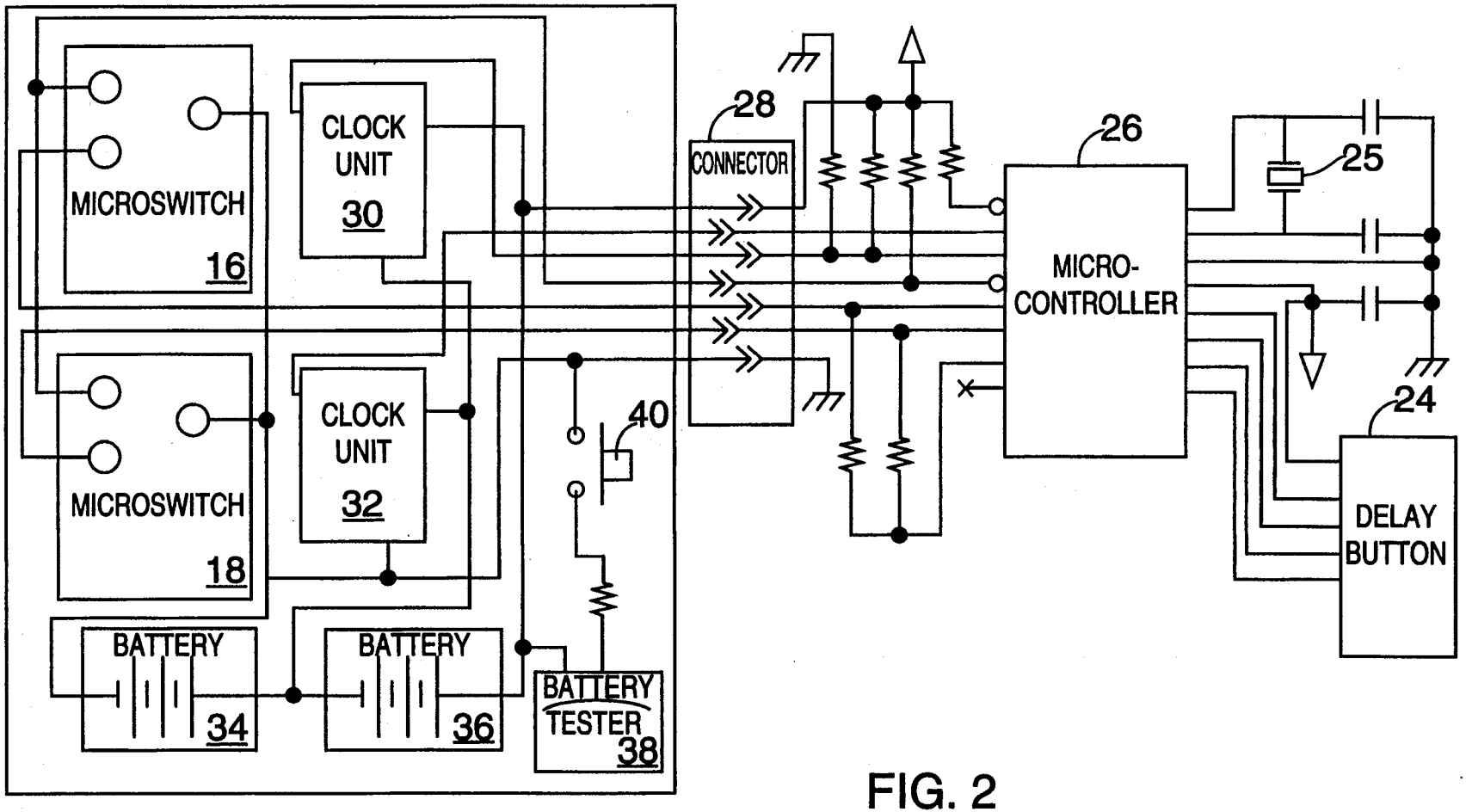
FIG. 2 is a schematic diagram of the control of the clock of FIG. 1.

Referring now to FIG. 2, there is shown a suitable circuit for a delay clock using a single delay button 24. In the embodiment of FIG. 2, delay button 24 is a thumbwheel switch. The thumbwheel switch 24 is connected to a microcontroller 26. The microcontroller is suitably a single chip microcontroller unit such as that sold by Motorola as part number 68HC705K1. A timing crystal 25 is also connected to the microcontroller 26. The microcontroller 26 is connected through a connector 28 to clock unit 30 and clock unit 32. Clock units 30 and 32 are interconnected with microswitches 16 and 18, cf. FIG. 1. The clocks are powered by batteries 34 and 36. A battery test meter 38 is included; it is activated through button 40.

The functioning of the circuit of FIG. 2 is as decribed hereinbefore with respect to the chess clock of FIG. 1. Thumbwheel 24 is rotated to select the desired period of delay. When either activation button 16 or 18 is pressed, microcontroller 26, in combination with timing crystal 25, delays the start of the clock unit 30 or 32 corresponding to the activation button 16 or 18 until after the elapse of the selected delay.

It will be appreciated that, while the embodiment of FIG. 2 is the best mode currently contemplated by the inventors for implementation of the delay feature, there are many other electronic circuits which could be used to accomplish the results of the present invention; similarly, the control of the delay feature could be done mechanically rather than electronically. It will, therefore, be understood that the claims are intended to cover all changes and modifications of the preferred embodiments of the invention herein chosen for the purpose of illustration which do not constitute a departure from the spirit and scope of the invention.

What is claimed is:

1. A chess clock for timing a chess match, said chess clock including:

(a) a first clock means and a second clock means, the clock means being adapted to run independently of each other;

(b) activation means for each of said clock means, each activation means having an operative and an inoperative position, one said activation means in its operative position activating the first clock means and deactivating the second clock means and the other said activation means in its operative position activating the second clock means while deactivating the first clock means, the two said activation means being interconnected so that movement of one activation means into its operative position simultaneously moves the other to its inoperative position; and (c) delay means associated with each one of said clock means, said delay means delaying the start of activation of the clock means with which it is associated for a preselected period of time after the activation means which activates that clock means is moved into the operative position.

2. The chess clock of claim 1 wherein the period of delay is from about 1 to about 9 seconds.

3. The chess clock of claim 1 wherein the period of delay is from about 3 to about 6 seconds.

4. The chess clock of claim 1 wherein the delay means is effective to delay the start of each of the clock means.

5. A chess clock for timing a chess match, said chess clock including:

(a) a first clock means and a second clock means, the clock means being adapted to run independently of each other;

(b) activation means for each of said clock means, each activation means having an operative and an inoperative position, one said activation means in its operative position activating the first clock means and deactivating the second clock means and the other said activation means in its operative position activating the second clock means while deactivating the first clock means, the two said activation means being interconnected so that movement of one activation means into its operative position simultaneously moves the other to its inoperative position; and (c) delay means associated with at least one said clock means, said delay means delaying the start of activation of the clock means with which it is associated for a preselected period of time after the activation means which activates that clock means is moved into the operative position.

6. The chess clock of claim 5 wherein the period of delay is from about 1 to about 9 seconds.

7. The chess clock of claim 5 wherein the period of delay is from about 3 to about 6 seconds.

8. The chess clock of claim 5 wherein the delay means is effective to delay the start of each of the clock means.

* * * * *